US008496479B2

(12) United States Patent
Rauser

(10) Patent No.: US 8,496,479 B2
(45) Date of Patent: Jul. 30, 2013

(54) RECOIL SYSTEM FOR FIREARMS

(76) Inventor: Willi Rauser, Oberndorf a.N. (DE)

( * ) Notice: Subject to any disclaimer, the term of this patent is extended or adjusted under 35 U.S.C. 154(b) by 199 days.

(21) Appl. No.: 13/051,319

(22) Filed: Mar. 18, 2011

(65) Prior Publication Data

US 2011/0275036 A1 Nov. 10, 2011

(30) Foreign Application Priority Data

May 4, 2010 (DE) ..... 20 2010 006 430 U

(51) Int. Cl.
*F41A 33/00* (2006.01)

(52) U.S. Cl.
USPC ..... 434/18; 434/11

(58) Field of Classification Search
USPC ..... 434/11–27
See application file for complete search history.

(56) References Cited

U.S. PATENT DOCUMENTS 6,869,285 B1 * 3/2005 Jones, II ..... 434/16
7,033,175 B2 * 4/2006 Kunimoto ..... 434/18
2005/0074726 A1 * 4/2005 Metcalfe et al. ..... 434/18
2005/0191601 A1 * 9/2005 Dvorak ..... 434/16
2012/0129136 A1 * 5/2012 Dvorak ..... 434/18

FOREIGN PATENT DOCUMENTS

EP 1 262 728 A1 12/2002
WO WO 98/14745 4/1998

* cited by examiner

*Primary Examiner* — Timothy A Musselman
(74) *Attorney, Agent, or Firm* — McGlew and Tuttle, P.C.

(57) ABSTRACT

A device (1) simulates the recoil of a firearm and has a breechblock (60) with a knockover slide (63). To avoid freezing up and outward emissions, a control mechanism controls a hydraulic working piston in working connection with the breechblock (60). A valve pressure lever (11) is deflected by movement of the knockover slide (63) to open a pressure valve (20), as a result of which fluid is fed to the working piston. The valve (20) has a movable separating piston (14) separating a hydraulic chamber (13) tightly from a gas chamber (17) filled with compressed gas. The separating piston (14) is acted on by the compressed gas. The working piston at the end of an adjusting movement brings about the closing of the valve (20) and opening of a discharge valve. The hydraulic fluid is guided, with open discharge valve, from the working piston into a return chamber (24).

20 Claims, 11 Drawing Sheets

RECOIL SYSTEM FOR FIREARMS

CROSS REFERENCE TO RELATED APPLICATIONS

This application claims the benefit of priority under 35 U.S.C. §119 of German Utility Model DE 20 2010 006 430.9 filed May 4, 2010, the entire contents of which are incorporated herein by reference.

FIELD OF THE INVENTION

The present invention pertains to a device for the simulation of the recoil of a firearm, which is retrofitted as a laser gun for training purposes and has a breechblock with a knockover slide which can be moved backwards and forwards between a closed starting position and an open end position.

BACKGROUND OF THE INVENTION

Laser guns of the type of this class are known, for example, from WO 98/14745. A recoil system for guns with installed laser for "sharp-shooting simulation" is described there. A specially made mechanism is used for triggering the recoil system. However, this mechanism only permits a trigger resistance, which does not correspond to the actual conditions of the different types of guns and therefore in practice is perceived as insufficient. Moreover, the prior-art recoil system requires an entire new construction or a reconstruction of prior-art pistols, which is extremely expensive in terms of construction and hence cost-intensive, wherein economic reconstruction is not possible or is ruled out to a large extent.

Furthermore, a laser pistol and a process for retrofitting a sharp-shooting pistol into a laser pistol is known from EP 1 262 728 A1. In this construction, a compressed gas magazine is provided, which is adapted, in terms of its dimensions, to the magazine of the respective model of the pistol to be retrofitted and is connected via a connecting valve to a magazine connecting piece. This magazine connecting piece has a passage hole with an opening pin for the connecting valve and a connection to the compressed gas magazine as well as a screw connection to an expansion chamber in the carriage above the barrel block. Moreover, the firing pin is retained in its position and actuation according to the model to be retrofitted. The piston is arranged in the expansion chamber with a hole running in the longitudinal direction and a firing pin piece movable backwards and forwards therein in front of the tappet of the valve. A little slip or a little play is provided between the firing pin piece and the piston inner wall for ventilation of the expansion chamber. Here, the spring rod with resetting spring is adapted to the prevailing pressure conditions to push back the piston and the firing pin piece via the carriage.

In this prior-art laser pistol the mechanics of most commercially available pistols shall be retained, so that the trigger pull or the pressure point of the original gun is likewise retained. A relatively simple reconstruction or a simple retrofit of previously known sharp-shooting pistols into pistols with a recoil simulation and laser triggering shall be made possible here. The reconstruction here shall only require the replacement of certain components, wherein a rebuilding into the original state shall be possible without problems.

Consequently, a compressed gas cartridge is used in this construction as is a special valve control, which is triggered with relative effort. Here it is found that because of the decreasing gas pressure in the compressed gas cartridge, the recoil simulation is weakened with increasing duration of the operation. Moreover, only an expensive replacement or an expensive refilling is possible after the compressed gas cartridge is used up. Further, it has been found that in systems of this type, which operate with compressed gas cartridges for "recoil simulation," the gun may cool off due to the essentially abrupt expansion of the gas. Especially when used in automatic guns with rapid firing sequence, it has been found that the gun may even "freeze up" after discharge of several volleys, such that the recoil system is put out of operation. Moreover, the compressed gas is discharged outwards, which is likewise undesirable.

SUMMARY OF THE INVENTION

Accordingly, the basic object of the present invention is to provide a device for the simulation of the recoil of a firearm, in which device, even in the case of longer operating time or after discharge of a plurality of shot sequences, a freezing up does not take place and, moreover, no outward emissions occur.

The object is accomplished according to the present invention with a device for the simulation of the recoil of a firearm which is retrofitted as a laser gun for training purposes and has a breechblock which can be moved backwards and forwards between a closed starting position and an open end position with a knockover slide. The device also includes a control mechanism is provided for the control of a hydraulic working piston, which is in indirect or direct connection with the breechblock of the firearm, and that the working piston can be acted on by a hydraulic fluid and can be adjusted into a working position moving the breechblock from its starting position into its end position, and that a valve pressure lever is provided, which can be deflected by an adjusting movement of the knockover slide and brings about an opening of a pressure valve, as a result of which hydraulic fluid can be fed under high system pressure to the working piston, and that the pressure valve is in connection with a hydraulic chamber accommodating the hydraulic fluid. The hydraulic chamber has a movable separating piston, which separates the hydraulic chamber tightly from a first gas pressure chamber filled with a compressed gas bringing about the system pressure and is acted on by the compressed gas with system pressure, and that the working piston indirectly or directly at the end of its adjusting movement brings about the closing of the pressure valve and the opening of the discharge valve at the same time or in a time-delayed manner, and that the hydraulic fluid is guided, with open discharge valve, from the working piston into a return chamber.

Due to the embodiment according to the present invention, a device for the recoil simulation of a firearm of any type is made available, in which neither a "freezing up" of the firearm—even with discharge of continuous firing—nor an outward emission, for example, of compressed gas may occur.

For this, a hydraulic-pneumatic combined pressure reservoir is provided for acting on the working piston with hydraulic fluid. The system pressure is preset in a pneumatic gas pressure chamber filled with compressed gas. A hydraulic chamber is directly assigned to this gas pressure chamber, wherein the hydraulic chamber and the gas pressure chamber are separated from one another by an axially adjustable separating piston. This separating piston is accordingly acted on by the pneumatic system pressure of the gas pressure chamber and transfers this system pressure to the hydraulic chamber due to its axially displaceable and tight mounting between the two chambers.

This hydraulic system pressure can be temporarily fed by means of a pressure valve which can be actuated via a control mechanism to the working piston, so that this working piston can essentially be abruptly adjusted from a resting starting position—possibly against a spring force of a piston resetting spring—into a working position. This adjusting movement is transmitted to the breechblock of the firearm, so that this moves from its closed starting position into its open end position. The opening of the pressure valve is brought about by the adjusting movement of the knockover slide, whose adjusting movement, as is generally known in firearms, is brought about, for example, by a knockover cock. The dimensioning of the gas volume of the gas pressure chamber, the hydraulic volume of the hydraulic chamber and the working volume together with the adjusting path of the working piston are coordinated with one another in such a way that a plurality of "shots" can be discharged without the system pressure becoming noticeably weakened. This system pressure may be 400 bar and higher and should not be below 100 bar in any case.

Furthermore, this control mechanism is designed such that the discharge valve is opened at best at the same time (but preferably in a time-delayed manner) as the closing of the pressure valve. Thus, when the discharge valve is opened, the working piston is "switched" without pressure. Due to the opening of the discharge valve, the working piston can now again move back into its starting position, which can be brought about, for example, by an integrated piston resetting spring. The hydraulic fluid located in the operating cylinder of the working piston is conveyed almost "without pressure" via the discharge valve into a return chamber during this return movement of the working piston. Consequently, this return chamber is gradually filled during the discharge of a plurality of "shots." An adjusting piston, which is mounted in an axially adjustable and tight manner in the return chamber for increasing the volume of the return chamber, may be provided here in the return chamber. If the hydraulic volume of the hydraulic chamber is completely used up, then the used-up hydraulic volume is consequently located entirely in the return chamber, and the adjusting piston has reached a predetermined end position accordingly.

In case of corresponding design of the pressure valve and of the discharge valve—for example in the form of nonreturn valves—as well as the ducting of pertinent connecting channels, the entire hydraulic fluid may again be conveyed back into the hydraulic chamber by resetting the adjusting piston in the return chamber from its end position into its initial starting position. The device is again "loaded" and can be used again in the firearm for discharge of the next "series of shots." Due to this "loading process" by means of simple pushing back of the adjusting piston in the return chamber, extremely short "loading times" can be achieved, such that the device can be kept ready for operation on site for multi-use without great expense.

Based on the embodiment according to the present invention, extremely high acceleration values of the breechblock can be achieved, so that a realistic recoil simulation can be achieved. In the device according to the present invention, furthermore, a fully closed pressure system is used, and no fluid is discharged outwards, so that this device can be used absolutely without risk for recoil simulation.

Provisions may be made that the control mechanism has a recoil lever, which is in connection with the breechblock, and that the recoil lever is pivotably mounted in a control head of a housing for the indirect control of the adjusting movement of the breechblock as well as for the indirect control of the pressure valve and of the discharge valve and can be driven in a rotating manner by the working piston or a piston rod of the working piston. Based on this embodiment of the control mechanism, the device can especially be used for small firearms. The movement energy of the working piston is transmitted by the recoil lever to the breechblock. The device may be used in the magazine mount of the firearm. I.e., only the part to be used in the magazine mount is to have small dimensions. The rest of the housing of the device protrudes transversely from the firearm, as this is also already known in cartridge magazines. In this inserted state, the recoil lever in the housing of the firearm is located in direct vicinity of the breechblock. The stroke direction of the working piston may now also be directed transversely to the adjusting direction of the breechblock, as a result of which it is also achieved that the housing may protrude transversely from the firearm. The stroke movement running transversely to the adjusting movement of the breechblock is converted by the recoil lever, which is preferably designed as an angle lever, into a pivoting movement, which in turn is transmitted to the breechblock, possibly with a predetermined transmission ratio.

In firearms with larger housings, the entire device can be inserted in the housing even in axial extension of the adjusting movement of the breechblock. In such cases, an indirect transmission of the movement energy of the working piston to the breechblock is not absolutely necessary, since the working piston may also be arranged in alignment with the breechblock. Thus, the breechblock may also be immediately directly driven by the working piston. Consequently, the recoil lever is not absolutely necessary for each purpose.

Furthermore, provisions may also be made for the pressure valve to have a tappet, via which a valve ball of the pressure valve can be brought from its closed position into its open position, and that the tappet can be adjusted by a drag lever, whose adjusting movement is brought about by the valve pressure lever in its active, deflected working position. By means of the drag lever provided, when the tappet is pressed down and released, lateral forces and greater frictional forces caused thereby are avoided or are at least reduced to the extent that both the tappet and the valve pressure lever have an as low as possible amount of wear.

According to further aspects of the invention, provisions may be made that the active, deflected working position of the valve pressure lever is fixed by a breech catch which is provided with a locking element, meshing in a locking manner with the valve pressure lever, and that the recoil lever has a deflecting nose, which can be brought into working connection with a stop web of the breech catch in such a way that the breech catch can be adjusted from its meshed position locking with the valve pressure lever in the end range of the adjusting movement of the recoil lever into a position not locking the valve pressure lever. Based on this embodiment, especially when the discharge valve is closed, a sufficiently long opening time of the pressure valve is achieved, which depends essentially on the adjusting path of the recoil lever and thus also of the working piston. As a result, it is guaranteed that the working piston performs its maximum possible adjusting movement. Since the recoil lever releases the locking of the breech catch and thus of the valve pressure lever first in the end range of its own adjusting movement, it is also guaranteed that the pressure valve remains open until this adjusting path is reached and the working piston is acted on by system pressure. Thus, the breechblock can be reliably driven up to into its predetermined end position via the recoil lever against a spring force again resetting the breechblock.

Furthermore, provisions may be made that a spring-loaded adjusting lever is provided, which is held in an inactive starting position by the locking element of the breech catch, and that the breech catch can be brought by the deflecting nose after release of the valve pressure lever at the end of the adjusting movement of the recoil lever into a switching position, in which the adjusting lever is released, and that the adjusting lever, after its release, performs an adjusting movement, by means of which an additional lever element can be adjusted into an active pivoting position for opening the discharge valve. Based on this embodiment, it is guaranteed that the discharge valve opens only immediately after the pressure valve closes, since the activation of the adjusting lever, which opens the discharge valve via the lever element, depends on the adjusting path of the recoil lever. The recoil lever releases the breech catch provided for locking the breech catch in its inactive position first at best at the same time as the closing process of the pressure valve, so that an entire opening of the discharge valve can reliably take place only after the closing of the pressure valve. Thus, a "flowing through" of hydraulic fluid, under system pressure directly from the hydraulic chamber into the return chamber is reliably ruled out, so that pressure energy of the hydraulic fluid is fully usable and is not partly lost due to this type of "leak."

Based on further embodiment aspects according to the invention, a closing of the discharge valve is permitted with certainty only when the working piston has reached its original starting position. For this provisions are made that the active pivoting position of the lever element is fixed by a catch lever provided with a locking finger, which can be brought into locking connection in a spring-loaded manner with the lever element, and that the catch lever has a deflection lever located in the locked position of the catch lever in the movement path of the breechblock, and that the catch lever can be brought into a neutral position not locking the lever element by the return movement of the breechblock by an interaction of the breechblock with the deflection lever. Since the breechblock releases the locking action of the catch lever only shortly before reaching its original starting position and only then is the lever element again released for closing the discharge valve, the discharge valve may also be closed only shortly before reaching the initial starting position of the entire drive. Thus, the device is again "sharp" for discharging a new "shot" for recoil simulation certainly already shortly before reaching the starting position of the breechblock (and thus of the firearm itself). Based on this embodiment, the device is optimally suitable not only for discharging "single shots," but also for recoil simulation for continuous firing or even for single shot volleys.

Based on a further embodiment aspect, it is guaranteed that the adjusting lever cannot inadvertently hinder the opening of the discharge valve, since it is "forcibly moved" by the recoil lever upon its return into the starting position. For this, provisions are made that the recoil lever has an adjusting pin which can be brought into working connection with a return lever of the adjusting lever, and that the adjusting lever can be adjusted into its initial starting position via the return lever during the return movement of the recoil lever in its non-deflected starting position by the adjusting pin.

Various feature combinations taken alone by themselves or in different combinations with one another as well, for a more reliable operation of the device according to the present invention, are highly advantageous for recoil simulation. However, especially the mechanical functional components, which are embodied here essentially as levers, are also partly embodied in the form of slider controls. This is especially conceivable when the working piston, with sufficient installation space, acts on the breechblock immediately directly with an adjusting force.

The present invention is explained in detail below based on an exemplary embodiment in relation to the drawings. As already mentioned above, the drawing here is used only for a more detailed understanding of the present invention and its mode of operation. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
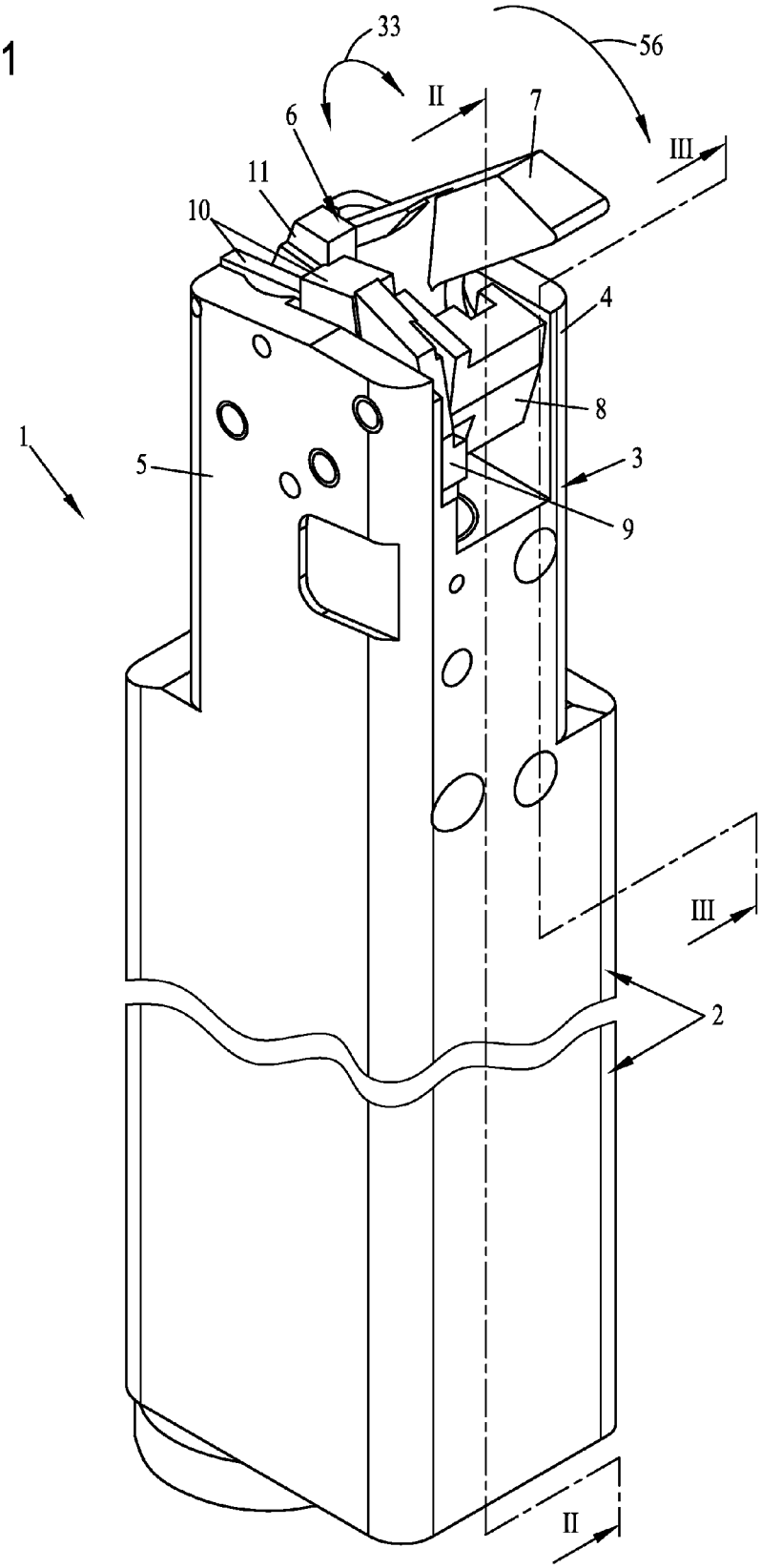
FIG. 1 is a perspective view of an exemplary embodiment of a device according to the present invention with a housing as well as a control head, which has a control mechanism.

Referring to the drawings in particular, FIG. 1 shows a perspective view of an embodiment variant of a device according to the present invention, which in the present exemplary embodiment has a housing 2. In the upper end range, this housing 2 forms a control head 3, which, in the upwards direction, forms two mounting walls 4 and 5 running parallel to one another and spaced apart from one another. A control mechanism 6, which in the present embodiment variant especially has a pivotably mounted recoil lever 7, is mounted between these mounting walls. FIG. 1 shows the recoil lever 7 in its released, active working position. This recoil lever 7 is used for the abrupt adjusting of a breech head of a firearm, as will be explained in detail later. This recoil lever 7 is deflected by a hydraulically actuatable working piston.

Furthermore, FIG. 1 also partly shows a breech catch 8, a catch lever 9, a spring-loaded bearing 10 as well as a pressure lever 11, whose mode of operation together with still other mechanical components not visible in FIG. 1 are used for controlling the adjusting movement of the recoil lever 7. Respective axial pressure springs, which bring about corresponding adjusting movements of the catch lever 9 and of the breech catch 8 in certain operating situations, may be provided between the spring-loaded bearing 10 arranged rigidly at the mounting wall 5 and the catch lever, on the one hand, and between the spring-loaded bearing 10 and the breech catch 8, on the other hand. The further lever parts described below in detail may be provided for performing its respective adjusting or return movement in the area of its bearing axes with a type of leg spring in each case, which are not shown in the drawing, since they are sufficiently known from the state of the art.

Figure 2:
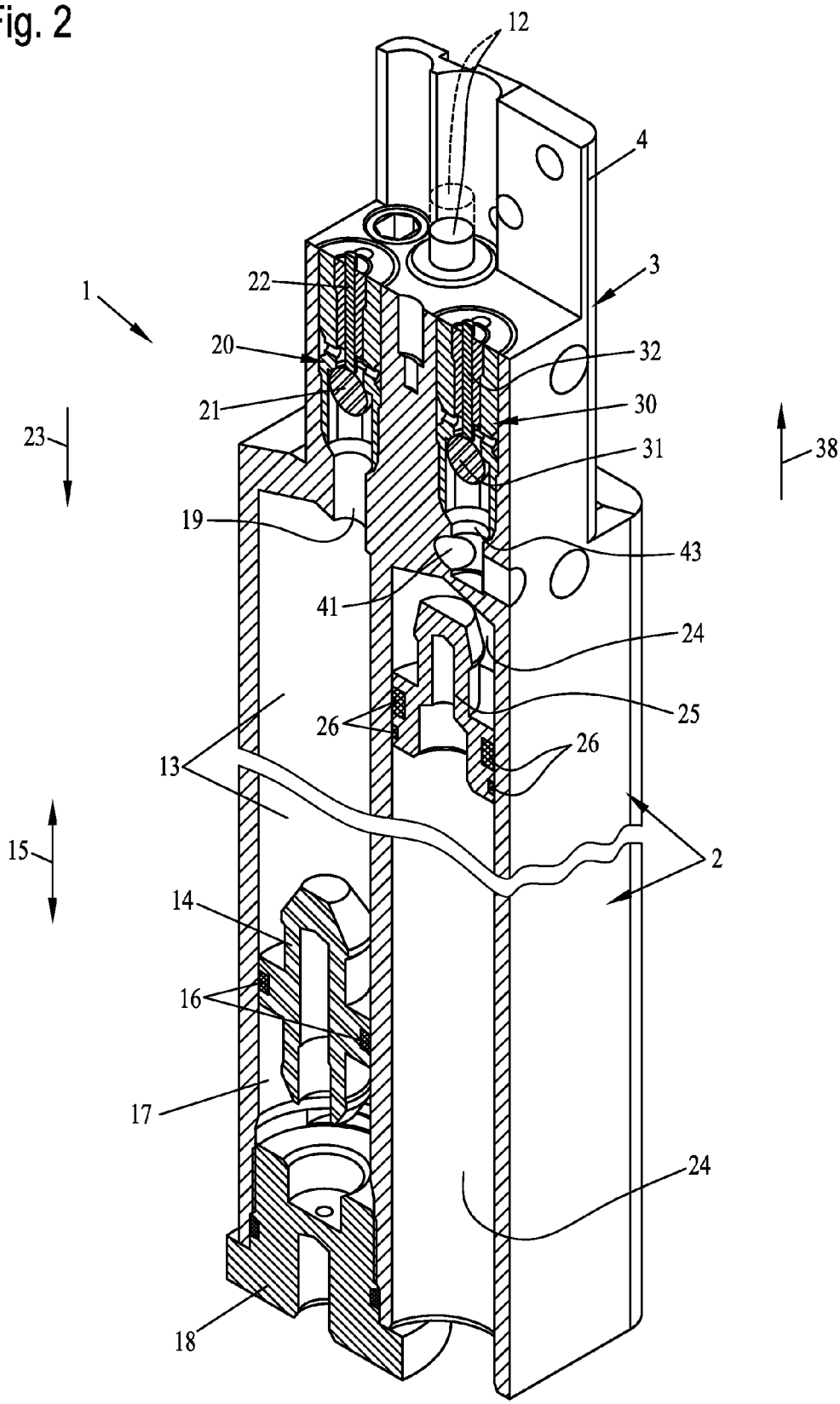
FIG. 2 is a section II-II of the device from FIG. 1 without control mechanism.

FIG. 2 shows a partial section II-II from FIG. 1 of the housing 2 without control mechanism 6 arranged in the control head 3 from FIG. 1.

Figure 3:
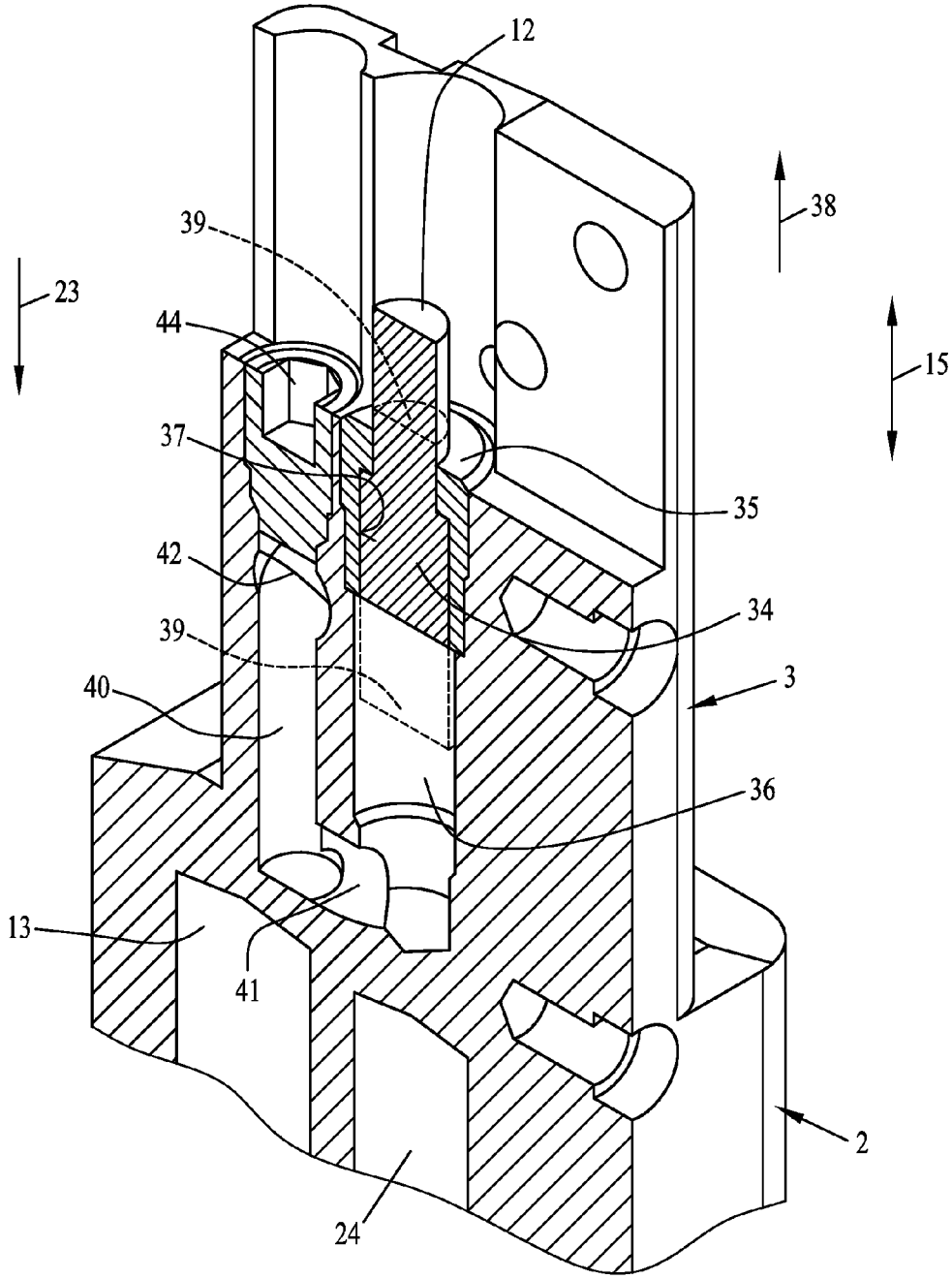
FIG. 3 is an enlarged partial section III-III of the control head of the device from FIG. 1 through the working piston likewise without control mechanism.

FIG. 2 shows in the area of the rear mounting wall 4 a piston rod 12, which is part of the above-mentioned working piston and which is characterized in FIG. 3 by reference number 34. It is, furthermore, evident from FIG. 2 that in the housing 2 is provided a hydraulic chamber 13, in whose lower area is axially adjustably mounted a separating piston 14 in the direction of double arrow 15. The separating piston 14 is tightly inserted in the hydraulic chamber 13 with a ring seal 16. It can be seen from FIG. 2 that the hydraulic chamber 13 under the separating piston 14 forms a first gas pressure chamber 17, which is tightly sealed on the bottom side by means of a breech screw. A pressure channel 19 leads from the hydraulic chamber 13 to a pressure valve 20, which is arranged fixed in the control head 3. This pressure valve 20 has a valve ball 21, which can be actuated via a tappet 22 for opening the pressure valve 20. I.e., upon actuation of the tappet 22, the valve ball 21 is adjusted in the direction of the arrow 23 and thus the pressure valve 20 is opened. The hydraulic chamber 13 accommodates a liquid hydraulic fluid, which, upon opening of the pressure valve 20, can be fed to the working piston 34 for activation of the working piston 34 from FIG. 3 and thus of the piston rod 12. The piston rod 12 moves upon pressurization of the working piston 34 from its starting position shown in continuous lines in FIG. 2 in the direction of the arrow 38 into the end position shown in dotted lines.

A downwards open return chamber 24, in which an adjusting piston 25 is adjustably arranged in the direction of double arrow 15, is assigned adjacent to the hydraulic chamber 13. The adjusting piston 24 is also axially adjustably hermetically mounted in the return chamber via ring seals 26. Above the return chamber 24 is provided a discharge valve 30, which likewise has a valve ball 31. This valve ball 31 can be actuated via a second tappet 32 and is used for the release of pressure of the working piston 34 from FIG. 3 of piston rod 12. I.e., after the closing of the pressure-side pressure valve 20, the discharge valve 30 is opened and thus hydraulic fluid reaches the return chamber 24 via the discharge valve 30 upon a return movement of the piston rod 12 together with the working piston 34 from FIG. 3. During this backflow of hydraulic fluid, the adjusting piston 24 moves downwards in the direction of arrow 23. Furthermore, a horizontally running connection channel 41 can be seen, in the form of a suggestion, from FIG. 2, which connects, among other things, a cylinder 36 of the working piston 34 from FIG. 3 to a return channel 43 of the discharge valve 30.

Thus, it is easily conceivable that hydraulic fluid can be fed to the working piston from FIG. 3 in connection with the piston rod 12 due to alternating opening of the pressure valve 20 as well as of the discharge valve 30 and hydraulic fluid can be discharged during the return movement of the working piston. By means of corresponding control, piston rod 12 of the working piston thus performs an alternating movement in the direction of double arrow 15, as a result of which the spring-loaded recoil lever 7 performs a corresponding, alternating movement or a fluctuating, pivoting movement in the direction of double arrow 33 (FIG. 1) for the movement of a breech head of a firearm.

In this regard, FIG. 3 shows a perspective, enlarged partial section of the upper end range of the housing 2 together with the control head 3. For the sake of clarity, FIG. 3 does not also show the control mechanism 6. It can be seen that a cylinder liner 35 is inserted in a central, vertically aligned cylinder 36. This cylinder liner 35 has a passage hole 37 offset in the axial direction, in whose upper section, which has a tapered design, the piston rod 12 is mounted without clearance. In the radially expanded area of this passage hole 37, the actual working piston 34 is connected to this piston rod 12. Here, this working piston 34 is in the position shown in FIG. 3 in its working position deflected in the direction of arrow 38. In its neutral starting position, the working piston 34 is adjusted vertically downwards together with the piston rod 12 in the direction of the arrow 23, as this can be seen by the dotted lines 39 in FIG. 3.

Furthermore, FIG. 3 shows a pressure channel 40, arranged laterally next to the working piston 34, which is in connection with the cylinder 36 with its lower end area via the connecting channel 41. Approximately at the level of the dotted lines 39 of the working piston 34, a cross hole 42 is provided, which, in the present exemplary embodiment, leads from the drawing plane to the pressure valve 20 not visible in FIG. 3. I.e., when the pressure valve 20 from FIG. 2 is opened, the cylinder 36 can be acted on by hydraulic fluid under system pressure via the cross hole 42, the pressure channel 40 as well as the connecting channel 41, so that the working piston 34 is adjusted from its starting positions shown in dotted lines 39 in FIG. 3 into the end position shown in continuous lines. If the pressure in the cylinder 36 is again exhausted, then the working piston 34 moves back in turn into the starting position shown in dotted lines 39, which is brought about by a resetting spring of the working piston 34 not shown in the drawing.

In this return movement in the direction of arrow 23, the pressure valve 20 is closed again. To be able to bring the hydraulic fluid located in the cylinder 36 below the working piston 34 into the return chamber 24 shown in FIG. 2, the discharge valve 30 opens. Here, the connecting channel 41 is embodied extended in the horizontal direction and leads from the cylinder 36 into a first return channel 43 below the discharge valve 30 (FIG. 2). This discharge valve 30 is, for its part, in turn in connection with the return chamber 24 by a second return channel (cannot be seen in FIG. 2), so that hydraulic fluid can reach the return chamber 24 via these channels. Here, the adjusting piston 24 moves vertically downwards in the return chamber 24 in the direction of arrow 23, as a result of which the volume of the return chamber 24 is increased by a corresponding volume.

I.e., based on this special control of the pressure valve 20 and of the discharge valve 30, the working piston 34 together with its piston rod 12 performs an alternating adjusting movement in the direction of double arrow 15. This in turn brings about an alternating pivoting movement of the recoil lever 7 into the direction of double arrow 33 shown in FIG. 1.

Figure 4:
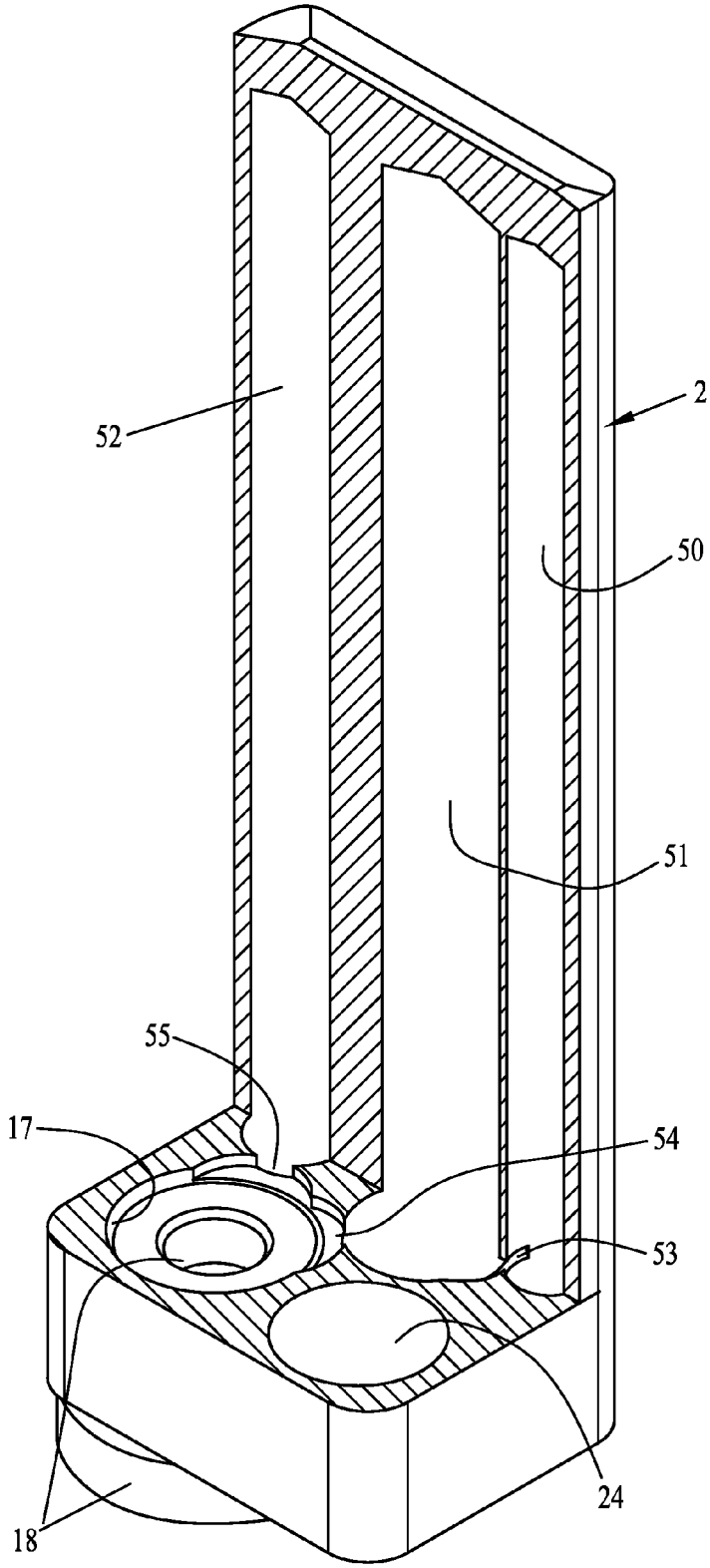
FIG. 4 is a combined horizontal and vertical section of the housing of the device from FIG. 1 with the view of three additional gas pressure chambers as well as a partial horizontal section of the first gas pressure chamber and the return chamber.

In order to be able to act on the first gas pressure chamber 17 with the necessary system pressure, a plurality of gas pressure chambers 50, 51, 52 are provided in housing 2 in the present exemplary embodiment, as this can be seen in the perspective, combined horizontal and vertical sectional view of FIG. 4. Here, it is evident from FIG. 4 that these gas pressure chambers 50, 51 and 52 are arranged in the housing 2 running parallel to the partially visible gas pressure chamber 17 with its breech screw 18 as well as the return chamber 24. Here, the gas pressure chambers 50 and 51 are in connection with one another in their lower end range via a corresponding slot connection 52, so that corresponding compressed gas from the gas pressure chamber 50 can "flow back" into the pressure chamber 51. Furthermore, the two gas pressure chambers 51 and 52 are in connection with the first gas pressure chamber 17 via a slot connection 54 and 55, respectively, so that corresponding gas can flow back in the direction of arrow 38 into the first gas pressure chamber 17 upon an upwards movement of the separating piston 14 (FIG. 2).

Because of the gas pressure chambers 50, 51 and 52 provided, the gas pressure bringing about the system pressure in the hydraulic chamber 13 is thus only inconsiderably reduced after a gradually performed adjusting movement of the separating piston 14 in the direction of arrow 38, so that especially the working piston 34 is acted on at least approximately with the same system pressure upon its upward movement in the direction of arrow 38 (FIG. 3) via the complete working stroke of the separating piston 14. Accordingly, the adjusting forces on the piston 12 during the upwards movement in the direction of arrow 38 during each working stroke are approximately constant as well. Thus, the recoil lever 7 shown in FIG. 1 is also driven with a correspondingly constant torque in the direction of arrow 56.

For filling the first gas pressure chamber 17 as well as the other gas pressure chambers 50 to 52 communicating with same, the breech screw may, for example, be provided with a corresponding pressure connection.

The hydraulic chamber 13 can be filled with hydraulic fluid, for example, via the pressure channel 40 shown in FIG. 3, which is closed on the top side with a corresponding breech screw 44. The system is filled with hydraulic fluid preferably in the pressureless state, so that the breech screw 44 does not have to have any pressure connection, but rather only has to be removed for filling.

The mode of operation of the present invention is explained in detail, for example, in the drawing figures below.

Figure 5:
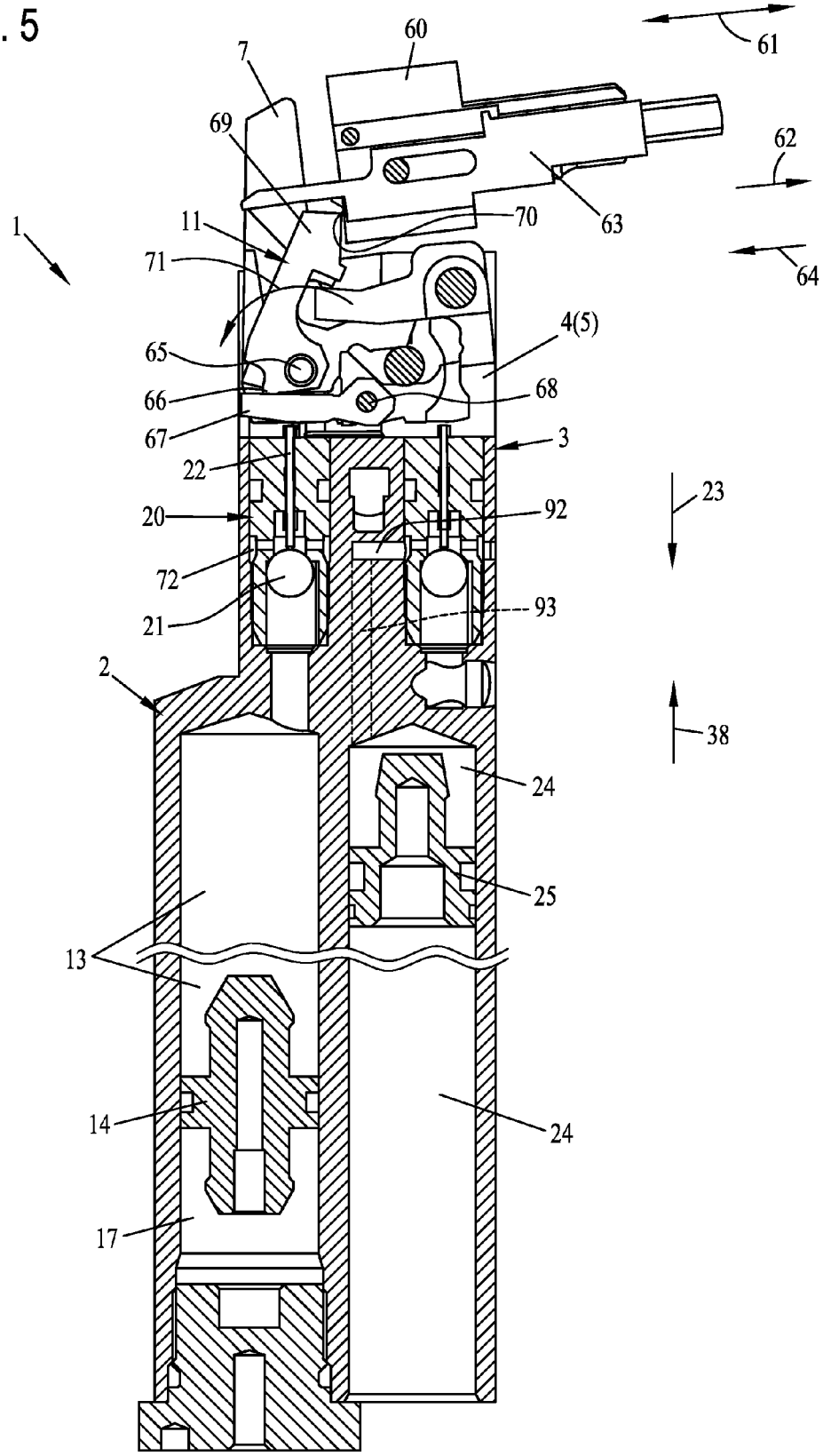
FIG. 5 is a vertical section of the device from FIG. 1 together with a breechblock and a knockover slide in the starting position of all components.

Thus, FIG. 5 shows a vertical section through the housing 2 with its control head 3, wherein the sectional plane is guided approximately centrally through the hydraulic chamber 13 and the first gas pressure chamber 17. The housing 2 is shown axially shortened in the area of this hydraulic chamber 13 as well as of the gas pressure chamber 17.

The device 1 according to the present invention is designed in the present exemplary embodiment in such a way that this can be inserted into the magazine mount of a firearm (not shown in detail). In this area, such a firearm has a so-called breechblock 60, which is movable backwards and forwards in the direction of double arrow 61. In a conventional "live" firearm, after the shot has been discharged, this breechblock is abruptly moved against a spring force in the direction of arrow 62 because of the gas pressure of the cartridge. A so-called knockover slide 63 is used to trigger a shot, which can be moved abruptly by a knockover cock not shown in the drawing in the direction of arrow 64. At the end of its adjusting movement, the knockover slide 63 triggers the firing of an inserted cartridge and thus a shot.

Since now the normally present magazine is replaced by the device 1 according to the present invention, consequently also no shot can be triggered, so that also no gas pressure brought about by the cartridge can move the breechblock 60 to the right in the direction of arrow 62. It is also consequently absent on the usually present "recoil," which is, however, simulated by the device 1 according to the present invention.

For this, the recoil lever 7 is located in the pulled-back, starting position shown in FIG. 5 in the movement path of the breechblock 60. Furthermore, it can be seen that the valve pressure lever 11 is located in the movement path of the knockover slide 63. This valve pressure lever 11 is pivotably mounted in the mounting walls 4 and 5 via a bearing axis 65. The valve pressure lever 11 forms, on the bottom side, a release element 66, which is mechanically in working connection with a drag lever 67. This drag lever 67 is likewise pivotably mounted in the mounting walls 4 and 5 via a corresponding bearing axis 68.

The valve pressure lever 11 forms a deflection lever 69, which is located in the starting position shown in FIG. 5 in the direct vicinity of a deflection surface 70 of the knockover slide 63. If the knockover slide 63 is now abruptly moved in the direction of arrow 64, then the valve pressure lever 11 is pivoted about its bearing axis 65 in the direction of arrow 71 by the mechanical working connection between the deflection surface 70 and the deflection lever 69. This in turn brings about an essentially upwards movement of the release element 66, directed vertically in the direction of arrow 23, as a result of which the drag lever 67 is likewise adjusted downwards in the direction of arrow 23. This adjusting movement is then transmitted to the tappet 22 of the pressure valve 20, so that its valve ball 21 is lifted from its valve seat in the direction of arrow 23. Accordingly, hydraulic fluid, which is accommodated under high system pressure in the hydraulic chamber 13, can reach a circumferential annular chamber 72 of the pressure valve 20. This annular chamber 72 is in working connection with a cross hole that cannot be further seen in the drawing, but is suggested in FIG. 3. Accordingly, the hydraulic fluid, which is under pressure, as already mentioned regarding FIG. 3, can be fed to the cylinder 36 of the working piston 34 from FIG. 3 via this cross hole 42, the pressure channel 40 as well as the connecting channel 41.

Figure 6:
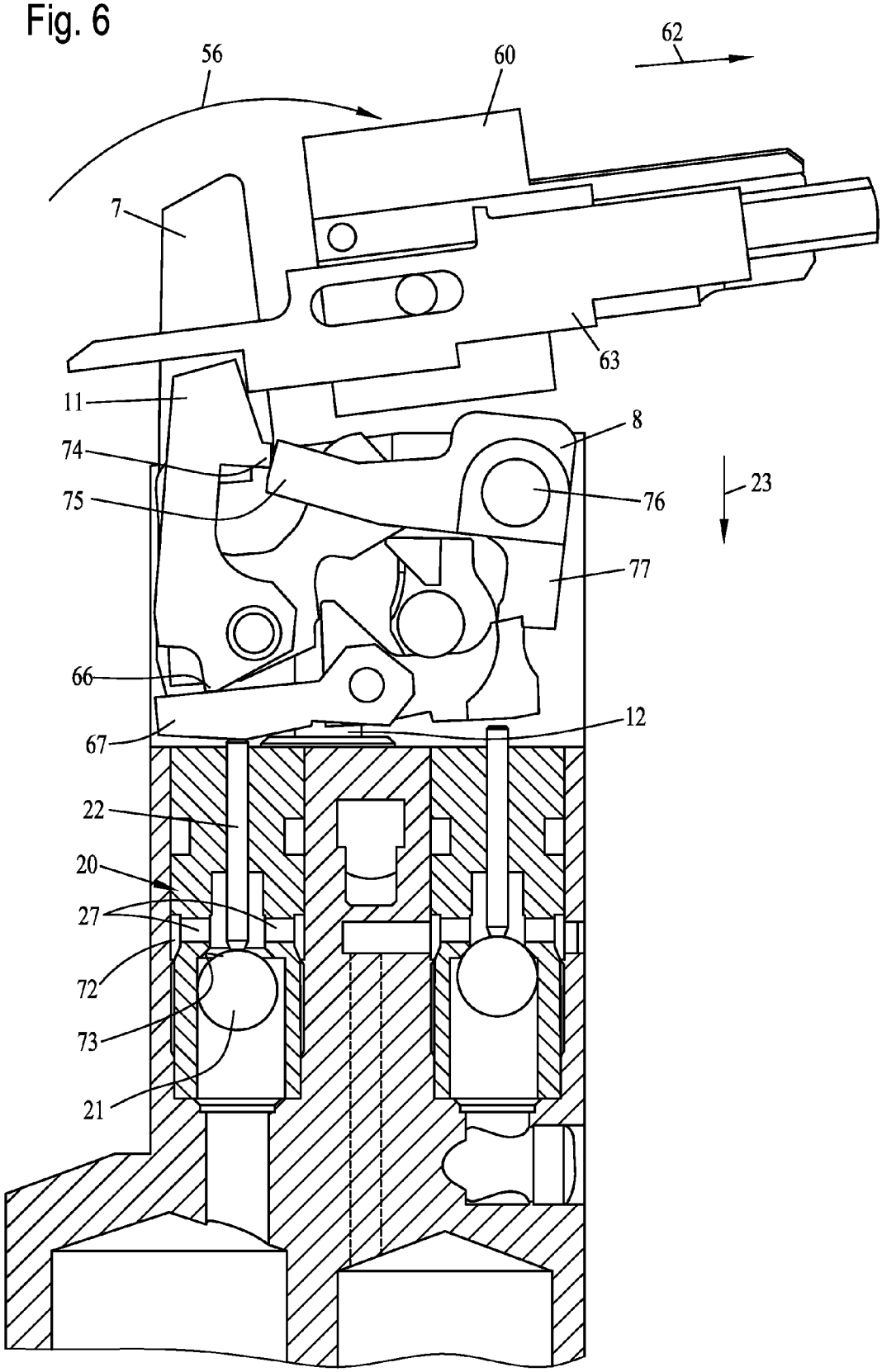
FIG. 6 is an enlarged sectional view of the control head of the device from FIG. 5 after activation of the knockover slide and open pressure valve.

The end position of the knockover slide 63 as well as of the valve pressure lever 11 is obvious in FIG. 6. It likewise can be seen that the drag lever 67 is pressed vertically downwards by means of the release element 66 of the valve pressure lever 11 in the direction of arrow 23. Accordingly, the tappet 22 is also adjusted in the same direction, so that the valve ball 21 is located in a raised, vertically downwards adjusted position in relation to its valve seat 73. Behind the drag lever 67, the piston rod 12 of the working piston 34, which is not further visible, is visible in FIG. 6. Also visible from FIG. 6 is the annular chamber 72 of the pressure valve 20 into which cross holes 27 of the pressure valve 20 open.

Since the working piston 34 (FIG. 3) is now acted on by system pressure, the recoil lever 7 is rotatingly deflected in the direction of arrow 56 by the piston rod 12. Here, it comes into contact with the breechblock 60, so that it is abruptly adjusted by this adjusting movement of the recoil lever 7 in the direction of arrow 62. In this deflected position of the valve pressure lever 11, this is secured by the breech catch 8, which locks on a corresponding locking nose 74 with a locking element 75. Here, the breech catch 8 is held in this locked position by spring force. This locked position is defined by a stop web 77 directed vertically downwards radially to the bearing axis 76 of the breech catch 8. By the locking of the valve pressure lever 11 in the position shown in FIG. 6, it is thus guaranteed that the pressure valve 20 remains open at least over a certain time, so that the working piston 34 (FIG. 3) with its piston rod 12 can perform a complete working stroke for deflecting or pivoting the recoil lever 7 in the direction of arrow 56.

Figure 7:
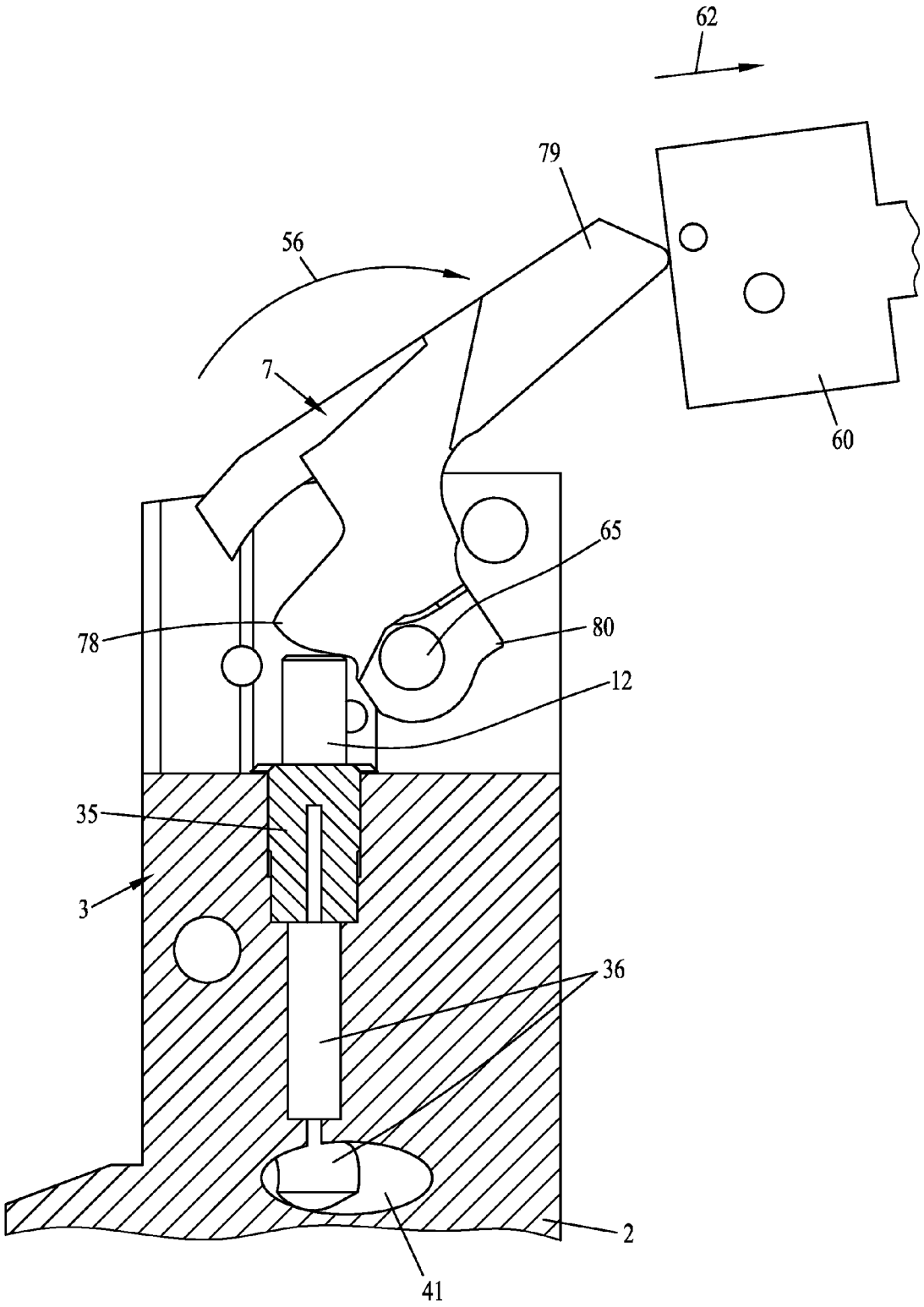
FIG. 7 is a sectional view of the control head from FIG. 6 with a slice in the area of the working piston after activation of the working piston.

For this, FIG. 7 shows a sectional view of the housing 2 together with the control head 3, whose slice lies approximately in the plane of the cylinder 39. In FIG. 7, the cylinder liner 35 as well as the piston rod can be seen in the partial section. It is obvious that the piston rod 12 is located in its "extended" working position. The recoil lever 7 was adjusted in the direction of arrow 56 and the breechblock in the direction of arrow 62 accordingly. For the sake of clarity, FIG. 7 does not show the other elements of the control mechanism. In the area surrounding its bearing axis 65, the recoil lever 7 forms an adjusting element 78, running radially to this bearing axis 65, which is in corresponding working connection with the piston rod 12. This adjusting element has together with the piston rod 12 a relatively small radial distance to the bearing axis 65, while the recoil lever 7 with its upper striking element 79 has a relatively large radial distance to the bearing axis 65. Due to these different "lever lengths," an extremely high lever ratio is achieved, so that the breechblock 60 can also be sufficiently accelerated by the striking element 79 in the direction of arrow 62.

Figure 8:
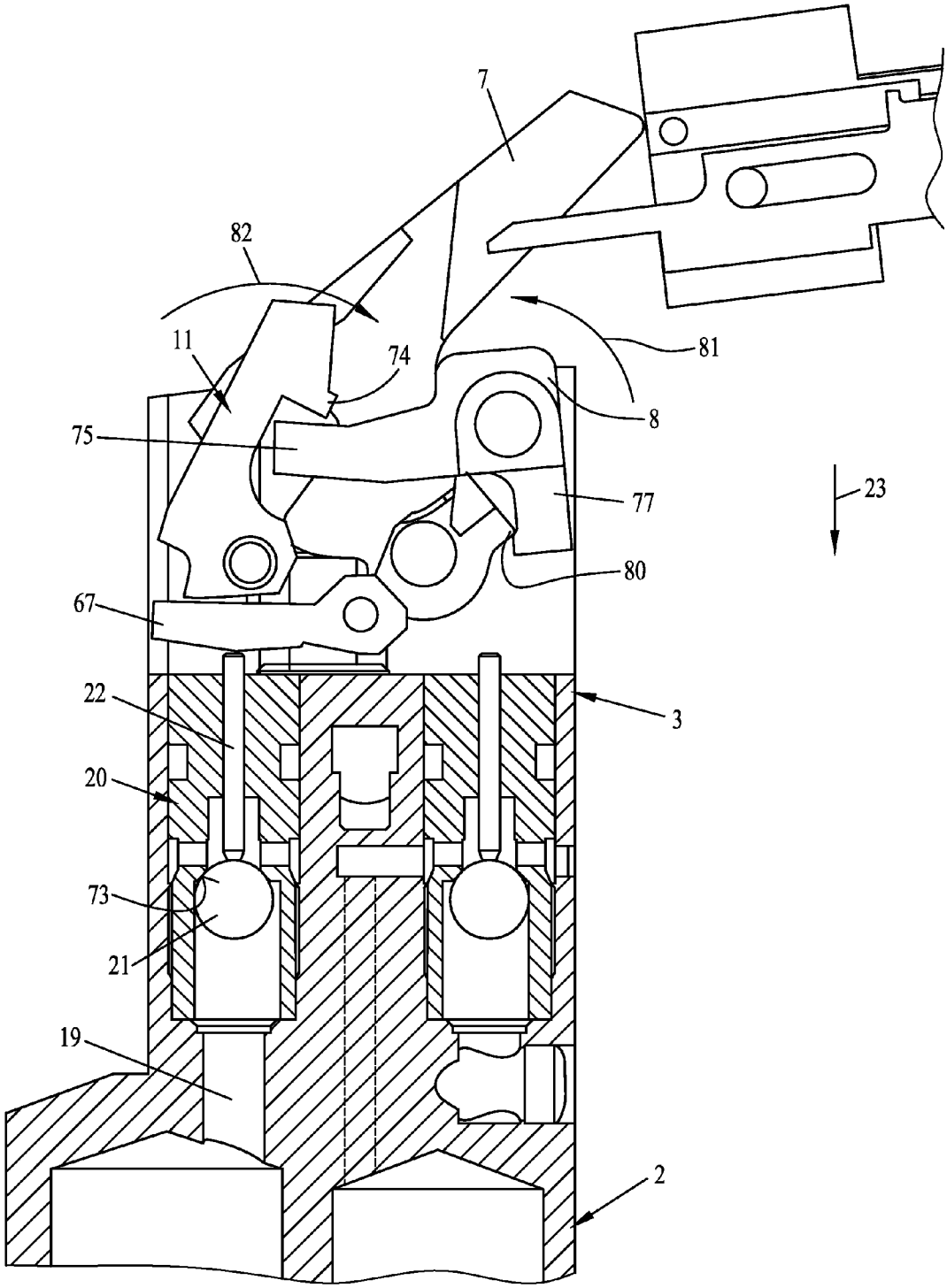
FIG. 8 is the sectional view from FIG. 6 after closing the pressure valve.

Furthermore, a deflecting nose 80, which can be brought into working connection with the stop web 77 of the breech catch (FIG. 6), is provided at the recoil lever 7, essentially diametrically opposed to the adjusting element 78. FIG. 8 shows a sectional view of this working connection. It can be seen that, due to the adjusting movement of the recoil lever 7, this deflecting nose 80 slides along on the inside of the stop web 7 and thus this stop web together with the entire breech catch 8 is moved in the direction of arrow 81 against a spring force. Thus, the breech catch 8 with its locking element 75 becomes unmeshed from the locking nose 74 of the valve pressure lever 11, so that the valve pressure lever 11 can again move back into its starting position in the direction of arrow 82. This return movement is likewise brought about by a spring force.

Furthermore, the drag lever 67 is thus also released and moves vertically upwards in the direction of arrow 38, so that the tappet 22 of the pressure valve 20 is also released. Thus, the valve ball 21 in turn closes, since it again arrives at its valve seat 73 by means of the system pressure acting in the pressure channel 19. The cylinder 36 of the working piston 34 (FIG. 3) is now thus separated from the hydraulic chamber 13, so that no more hydraulic fluid can "flow back". This flowing back of hydraulic fluid is, however, also limited by the limited adjusting movement of the working piston 34, since the working piston 34 is embodied as radially offset against its piston rod 12, as this is evident from FIG. 3. After closing of the pressure valve 20, the working piston 34 may now again be released.

Figure 9:
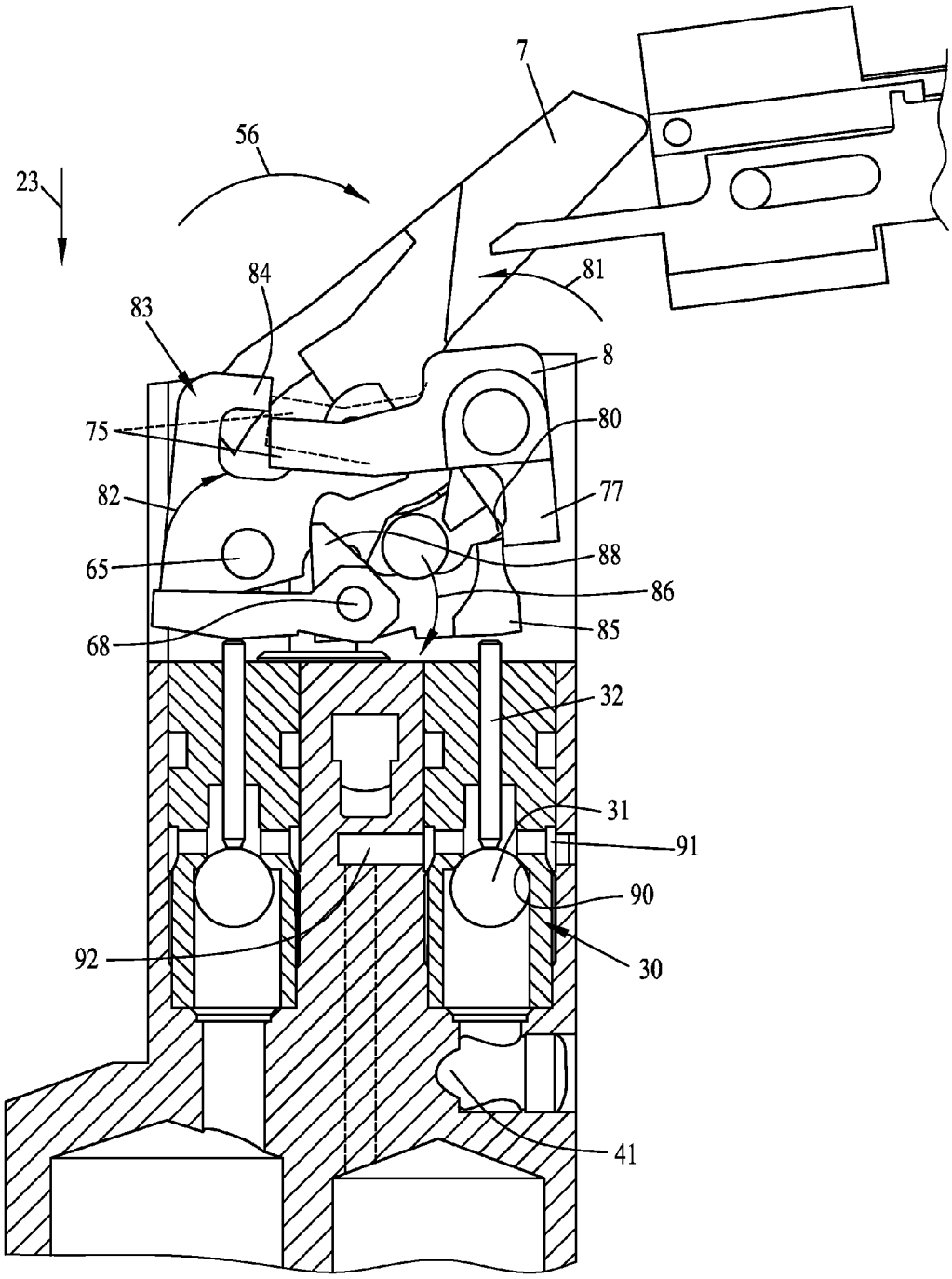
FIG. 9 is the sectional view from FIG. 6 with the mechanical components for opening the discharge valve immediately before the activation thereof.

This happens by a further adjusting movement of the recoil lever 7. FIG. 9 shows a sectional view of this further adjusting movement. A further adjusting lever 83, which is fixed in a starting position (shown in dotted line) in the position of the breech catch 8 shown in FIG. 8 by means of its locking element 75, is located behind the valve pressure lever 11, which is not shown in detail in FIG. 9. The adjusting lever 83 is likewise rotatably mounted on the bearing axis 65 of the valve pressure lever 11. By means of a leg spring or the like, the adjusting lever 83 is acted on by a spring force in the direction of arrow 82. If the recoil lever 7 in the position shown in FIG. 9 is now moved further in the direction of arrow 56, then the breech catch 8 is rotated further in the direction of arrow 8 via the deflecting nose 80 and its stop web 77, so that the locking element 75 of the breech catch 8 is moved vertically downwards in the direction of arrow 23 and a locking nose 84 of the adjusting lever 83 is thus released. A lever element 85, which is rotatably mounted on the bearing axis 68 of the drag lever 67, is in turn shifted by means of this release into a rotary movement in the direction of arrow 86.

This rotary movement of the lever element 85 is brought about by the adjusting lever 83. For this, this adjusting lever 83 has a sliding surface 87 directed towards the lever element 85, which is in working connection with an actuation element of the lever element 85. Furthermore, it can be seen from FIG. 9 that the lever element 85 is arranged above the tappet 32 of the discharge valve 30. If the lever element 85 accordingly performs a rotary movement in the direction of arrow 86, then the lever element 85 moves vertically downwards with its outer end in the direction of arrow 23. This is turn brings about an adjusting movement of the tappet 32 in the same direction, so that the valve ball 31 of the discharge valve 30 is likewise moved in the same direction. Thus, this valve ball 31 rises from the valve seat 90 of the discharge valve 30, so that the discharge valve 30 is opened.

Thus, hydraulic fluid can flow back through the discharge valve 30 via a correspondingly designed channel system, and especially via the cylinder 60 and the connecting channel 41 shown by way of suggestion in FIG. 9. This discharge valve 30 likewise forms a circumferential annular channel 91, which opens into a discharge channel 92. This discharge channel 92 is in turn in connection with the return channel 93 shown in dotted lines in FIG. 5. Thus, the hydraulic fluid reaches the return chamber 24 shown in FIG. 5 when the discharge valve 30 is open. Due to this flowing back of the hydraulic fluid into the return chamber 24, its adjusting piston 25 is adjusted vertically in the direction of arrow 23, so that the cylinder 36 of the working piston 34 is completely without pressure. This working piston 34 can thus again be adjusted into its starting position 39 shown in dotted lines in FIG. 3 by means of spring force (wherein the compression spring is not shown in the drawing).

Figure 10:
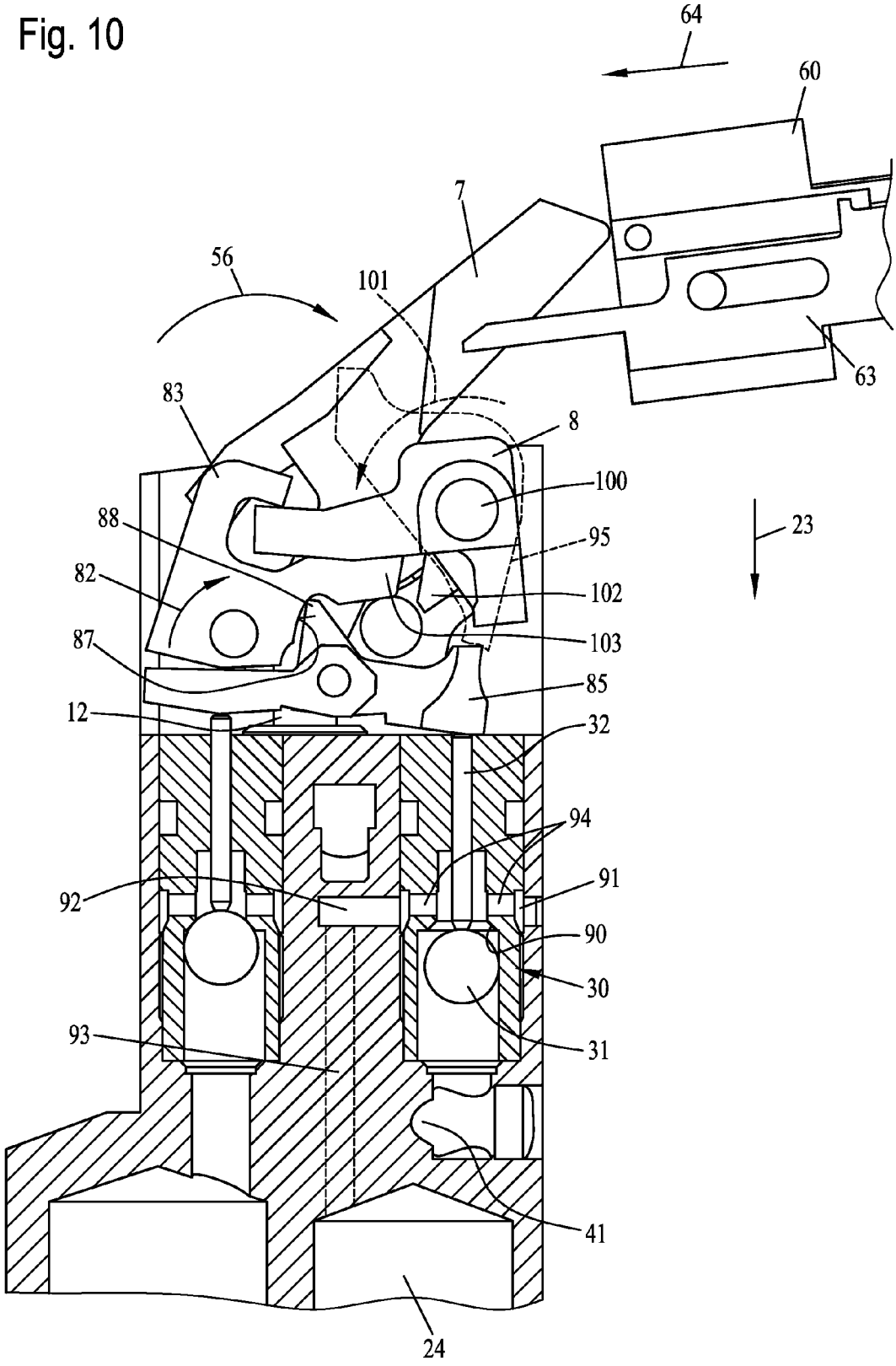
FIG. 10 is the sectional view from FIG. 9 in a functional position of the functional components with open discharge valve and closed pressure valve.

This open position of the discharge valve 30 is shown in FIG. 10. It is can be seen that the lever element 85 was adjusted into its end position pressing down the tappet 32 by its actuation element 88 via the abutting surface 87 of the adjusting lever 83. The valve ball 31 is raised from the valve seat 90. Through corresponding cross holes 94, hydraulic fluid now reaches the annular channel 91 of the discharge valve 30 from the connecting channel 41 via the cross holes 94 and from there the return chamber 24 via the discharge channel 92 also shown in FIG. 5 as well as the return channel 93. The lever element 85 is held in its adjusted working position of FIG. 10 by means of a catch lever 95. This catch lever 95, lying in front of the breech catch 8 in FIG. 10, is shown in dotted lines in FIG. 10 and is rotatably mounted on a common axis of rotation 100 together with the breech catch 8. The control lever 85 reaches the locked position shown in FIG. 10 because of a spring force.

Because the discharge valve 30 is now opened, hydraulic fluid can return into the return chamber 24 from the cylinder 36 of the working piston 34 via the connecting channel 41 through the discharge valve 30 or through its cross hole 94, the discharge channel 92 as well as the return channel 93 in connection with same. Thus, the working piston 34 from FIG. 3 is pressureless, so that it is moved back into a neutral position, shown in continuous lines 39 in FIG. 3, by means of a spring force. At the same time, the recoil lever 7 also again moves back into its starting position along arrow 56. At the recoil lever 7 is provided in the area of its deflecting nose 80 a transversely running adjusting pin 102, by means of which the adjusting lever is reset into its starting position along arrow 82 during the return movement of the recoil lever 7 along arrow 56. For this, the adjusting lever 83 has a return lever 103, which is in working connection with the adjusting pin 102 during the return movement of the recoil lever 7.

Figure 11:
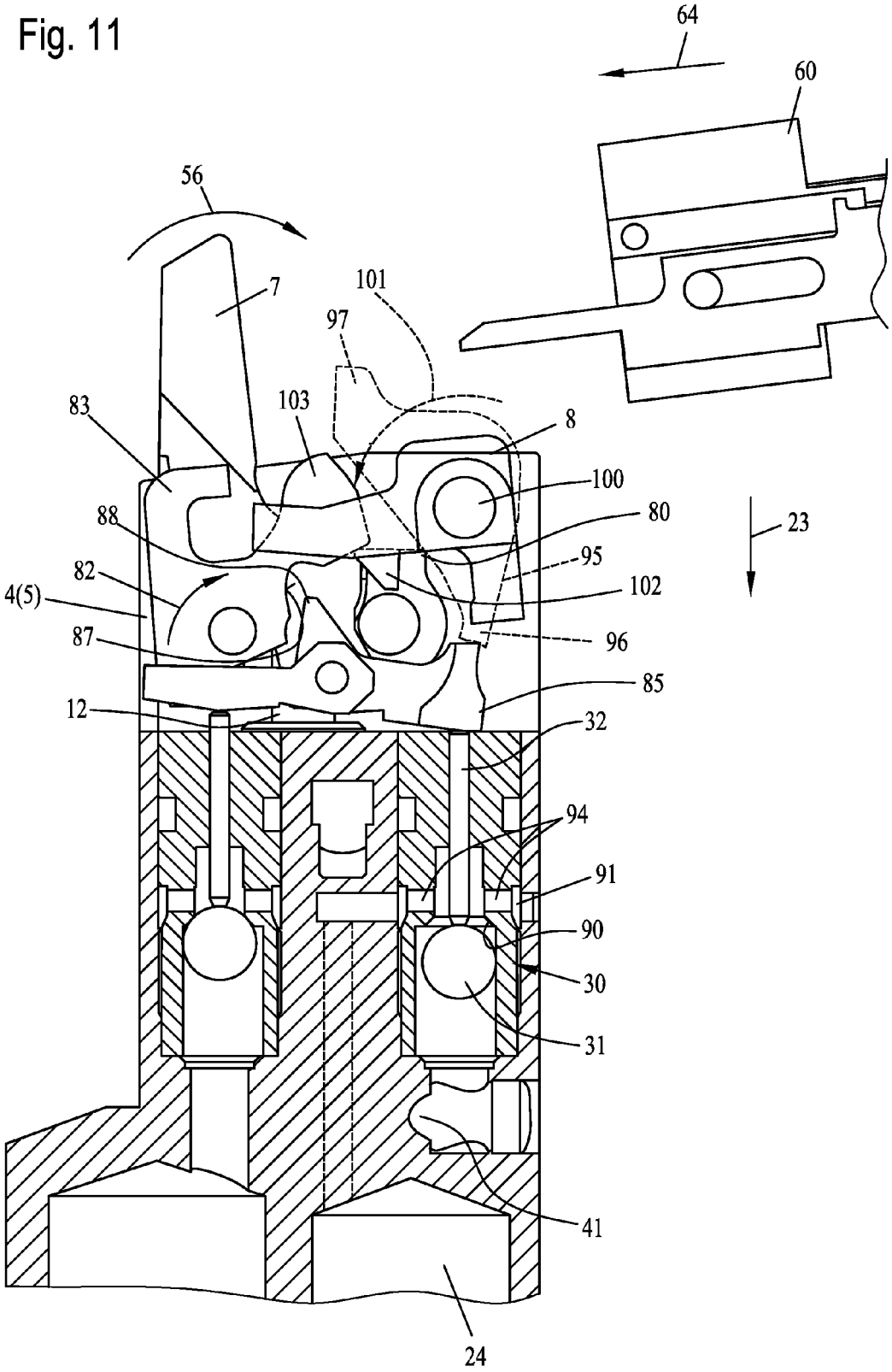
FIG. 11 is the sectional view from FIG. 10 with reset recoil lever and reset adjusting lever.

The reset position is shown in FIG. 11. It can be seen that the adjusting pin 102 meshes with the return lever 103 and the adjusting lever 83 is thus held in its starting position. Furthermore, it can likewise be seen from FIGS. 10 and 11 that the discharge valve 30 is likewise still open. This is caused by the locking action of the catch lever 95 with its locking finger 96.

Furthermore, it is evident from FIG. 11 that this catch lever 95 has a deflection lever 97 which projects vertically via the two mounting walls 4 and 5 and is approximately diametrically opposed to the locking finger.

If the breechblock 60 now moves in the direction of arrow 64, then it is in working connection with the deflection lever 97.

If the breechblock 60 from FIG. 10 together with the knockover slide 63 is now moved again back into the direction of arrow 64, then the locking lever 95 is moved back by the breechblock 60 in the direction of arrow 101, so that the lever element 85 is in turn released. However, before this it is necessary that the recoil lever 7 again reaches its starting position along arrow 56. This occurs likewise automatically by a spring force as soon as the piston rod 12 from FIG. 10 has again moved back into its starting position (see FIG. 3) in the direction of arrow 23.

After the return movement of the breechblock 60 into the starting position shown in FIG. 5, the control mechanism is likewise again completely reset into its starting position. By reactivation of the knockover slide 63, the next "shot" can now be brought about. The same sequences always take place as described above regarding drawing FIGS. 5 through 11.

The present invention is not limited to the control mechanism 6 shown. In the present invention, it is essential that the breechblock can be accelerated abruptly in the direction of arrow 62 by means of a combination of gas pressure chambers and a hydraulic chamber as well as a working piston and the special valve control. By means of the special embodiment of the control mechanism, the pressure valve and the discharge valve are actuated one after another, wherein, in the exemplary embodiment shown, this actuation also depends on the adjusting movement of the recoil lever. This adjusting movement of the recoil lever brings about the opening and closing of the pressure valve 20, on the one hand, and, on the other hand, likewise the opening of the discharge valve 30. This discharge valve 30 is closed again by means of the return movement of the breechblock 60, as described above, so that the system overall returns again into its starting state.

Due to the firing off of a plurality of shot sequences, the separating piston 14 (FIG. 5) is moved upwards in the hydraulic chamber 13 successively or gradually in the direction of arrow 38. After a certain number of "shots," which depends on the volume ratio of the hydraulic chamber 13, the piston stroke and piston cross section of the working piston 34, the separating piston 14 reaches an upper end position. At the same time, the adjusting piston 25 in the return chamber 24 gradually moves downwards in the direction of arrow 23 (FIG. 5), until it likewise reaches an end position.

After reaching the two end positions both of the separating piston 14 and of the adjusting piston 25, the device 1 can now be "loaded" again by simply pressing the adjusting piston 25 again in the direction of arrow 38 (under a possibly high expenditure of force). The hydraulic fluid located in the return chamber 24 is subsequently pushed through the return channel 93, discharge channel 92, annular channel 91 as well as cross holes 94 by means of the discharge valve 30. The discharge valve 30 is automatically opened, since this "overpressure" forcibly lifts the valve ball 31 from its valve seat 90. After the passing of the hydraulic fluid through the discharge valve 30, this [fluid] reaches the annular chamber 72 of the pressure valve 20 via the connecting channel 41 (FIGS. 3, 10 and 11), pressure channel 40 and cross hole 42. Because of the overpressure, the hydraulic fluid is now pressed into pressure valve 20 through the likewise present cross holes 27 of the pressure valve 20. As a result, an adjusting movement of the valve ball 21 in the direction of arrow 23 is brought about, so that this pressure valve 20 is likewise opened. Thus, the pressure medium again returns into the hydraulic chamber 13 via the pressure channel 19 shown, for example, in FIG. 6. Due to this "pressing back" of the hydraulic fluid into the hydraulic chamber 13, the separating piston 14 is thus in turn pressed downwards in the direction of arrow 23 (FIG. 5), until this has again reached its original starting position.

It is extremely advantageous of this design that the device according to the present invention has a closed hydraulic circuit and no compressed gas is discharged outwards during the operation. I.e., the device 1 is, on the one hand, to be filled at first with hydraulic fluid beforehand, and then corresponding compressed gas is filled into the gas pressure chambers 50, 51 and 52 as well as in the first gas pressure chamber 17 under high pressure. After the "filling" of the device according to the present invention, it is thus ready for use.

It should be mentioned at this point that especially the drive of the breechblock 60 brought about via the recoil lever 7 does not have to be absolutely embodied in this manner. The embodiment variant described refers to smaller firearms, in which only a small installation space is present for such a device 1. In this case, the housing 2 of the device 1 is embodied with its control head 3 in such a way that the control head 3 can be inserted into the magazine shaft of the corresponding firearm, so that the recoil lever 7 is located in the area of the movement path of the breechblock 60. In larger firearms, especially those with a larger housing, it is also recommendable that the breechblock 60 be driven directly by the piston rod 12 of the working piston 34. Accordingly, the control mechanism 6 is then also to be adapted in order to be able to perform the above-described valve control of the pressure valve 20 and of the discharge valve 30.

Of course, other control mechanisms with differently embodied "control levers" can also be recommended, which guarantee the same purpose or the same mode of operation, as described in the exemplary embodiment. Instead of such "pivoting levers," as are used presently in the control mechanism 6, slider controls and the like are also more recommendable.

While specific embodiments of the invention have been shown and described in detail to illustrate the application of the principles of the invention, it will be understood that the invention may be embodied otherwise without departing from such principles.

What is claimed is:

1. A device for the simulation of the recoil of a firearm which is retrofitted as a laser gun for training purposes, the device comprising:

a knockover slide;

a breechblock which can be moved backwards and forwards between a closed starting position and an open end position with the knockover slide;

a hydraulic working piston in indirect or direct working connection with the breechblock;

a control mechanism for controlling the hydraulic working piston, the working piston being acted on by hydraulic fluid and being adjusted into a working position moving the breechblock from the starting position into the end position;

a hydraulic chamber accommodating the hydraulic fluid;

a pressure valve;

a discharge valve;

a return chamber;

a valve pressure lever that is deflected by an adjusting movement of the knockover slide and brings about an opening of the pressure valve, as a result of which hydraulic fluid is fed under high system pressure to the working piston, the pressure valve being in connection with the hydraulic chamber;

a movable separating piston associated with the hydraulic chamber, the movable separating piston separating the hydraulic chamber tightly from a gas pressure chamber filled with a compressed gas bringing about the system pressure, the movable separating piston being acted on by the compressed gas, the working piston indirectly or directly, at the end of the adjusting movement bringing about a closing of the pressure valve and an opening of the discharge valve at the same time or in a time-delayed manner and the hydraulic fluid is conveyed, with the open discharge valve from the working piston into the return chamber; and an adjusting piston provided in said return chamber in an axially and adjustable, tight manner, said adjusting piston being movable from a start position to an end position for increasing a volume of said return chamber to receive said hydraulic fluid of said hydraulic chamber, wherein said hydraulic fluid is entirely conveyed back into said hydraulic chamber by resetting said adjusting piston in said return chamber from said end position to said starting position.

2. A device in accordance with claim 1, further comprising a housing wherein:

the control mechanism has a recoil lever in working connection with the breechblock; and the recoil lever is pivotably mounted in a control head of the housing for an indirect control of the adjusting movement of the breechblock as well as for an indirect control of the pressure valve and of the discharge valve; and the recoil lever is driven in a rotating manner by the working piston or a piston rod of the working piston.

3. A device in accordance with claim 1, wherein:

the pressure valve has a tappet, via which a valve ball of the pressure valve can be brought from the closed position into the open position; and the tappet can be adjusted by a drag lever, an adjusting movement of the tappet being brought about by the valve pressure lever in an active, deflected working position.

4. A device in accordance with claim 3, wherein:

the active, deflected working position of the valve pressure lever is fixed by a breech catch provided with a locking element, meshing with the valve pressure lever; and the recoil lever has a deflecting nose, which can be brought into working connection with a stop web of the breech catch in such a way that the breech catch can be adjusted from a breech catch meshed position locking with the valve pressure lever, in an end range of the adjusting movement of the recoil lever, into a position not locking the valve pressure lever.

5. A device in accordance with claim 4, further comprising a spring-loaded adjusting lever held in an inactive starting position by the locking element of the breech catch, wherein:

the breech catch is brought by the deflecting nose, after release of the valve pressure lever at the end of the adjusting movement of the recoil lever, into a switching position, in which the adjusting lever is released; and after release of the adjusting lever, the adjusting lever performs an adjusting movement, by means of which another lever element is adjusted into an active pivoting position for opening the discharge valve.

6. A device in accordance with claim 5, wherein:

the active pivoting position of the lever element is fixed by a catch lever provided with a locking finger, which can be brought into locking connection in a spring-loaded manner with the lever element;

the catch lever has a deflection lever located in the locked position of the catch lever in the movement path of the breechblock; and the catch lever is brought into a neutral position not locking the lever element by the return movement of the breechblock by an interaction of the breechblock with the deflection lever.

7. A device in accordance with claim 6, wherein the recoil lever has an adjusting pin that can be brought into working connection with a return lever of the adjusting lever; and the adjusting lever is adjusted into an initial starting position via the return lever during the return movement of the recoil lever in an adjusting lever non-deflected starting position by the adjusting pin.

8. A device for the simulation of the recoil of a firearm which is retrofitted as a laser gun for training purposes, the device comprising:

a knockover slide;

a breechblock which can be moved backwards and forwards between a closed starting position and an open end position with the knockover slide;

a hydraulic working piston in indirect or direct working connection with the breechblock;

a control mechanism for controlling the hydraulic working piston, the working piston being acted on by hydraulic fluid and being adjusted into a working position moving the breechblock from the starting position into the end position;

a hydraulic chamber accommodating the hydraulic fluid;

a pressure valve;

a discharge valve;

a return chamber;

a valve pressure lever that is deflected by an adjusting movement of the knockover slide and brings about an opening of the pressure valve, as a result of which hydraulic fluid is fed under high system pressure to the working piston, the pressure valve being in connection with the hydraulic chamber;

a movable separating piston associated with the hydraulic chamber, the movable separating piston separating the hydraulic chamber tightly from a gas pressure chamber filled with a compressed gas bringing about the system pressure, the movable separating piston being acted on by the compressed gas, the working piston indirectly or directly, at the end of the adjusting movement bringing about a closing of the pressure valve and an opening of the discharge valve at the same time or in a time-delayed manner and the hydraulic fluid is conveyed, with the open discharge valve from the working piston into the return chamber.

9. A device in accordance with claim 8, further comprising a housing wherein:

the control mechanism has a recoil lever in working connection with the breechblock; and the recoil lever is pivotably mounted in a control head of the housing for an indirect control of the adjusting movement of the breechblock as well as for an indirect control of the pressure valve and of the discharge valve; and the recoil lever is driven in a rotating manner by the working piston or a piston rod of the working piston.

10. A device in accordance with claim 8, wherein:

the pressure valve has a tappet, via which a valve ball of the pressure valve can be brought from the closed position into the open position; and the tappet can be adjusted by a drag lever, an adjusting movement of the tappet being brought about by the valve pressure lever in an active, deflected working position.

11. A device in accordance with claim 10, wherein:

the active, deflected working position of the valve pressure lever is fixed by a breech catch provided with a locking element, meshing with the valve pressure lever; and the recoil lever has a deflecting nose, which can be brought into working connection with a stop web of the breech catch in such a way that the breech catch can be adjusted from a breech catch meshed position locking with the valve pressure lever, in an end range of the adjusting movement of the recoil lever, into a position not locking the valve pressure lever.

12. A device in accordance with claim 11, further comprising a spring-loaded adjusting lever held in an inactive starting position by the locking element of the breech catch, wherein:

the breech catch is brought by the deflecting nose, after release of the valve pressure lever at the end of the adjusting movement of the recoil lever, into a switching position, in which the adjusting lever is released; and after release of the adjusting lever, the adjusting lever performs an adjusting movement, by means of which another lever element is adjusted into an active pivoting position for opening the discharge valve.

13. A device in accordance with claim 12, wherein:

the active pivoting position of the lever element is fixed by a catch lever provided with a locking finger, which can be brought into locking connection in a spring-loaded manner with the lever element;

the catch lever has a deflection lever located in the locked position of the catch lever in the movement path of the breechblock; and the catch lever is brought into a neutral position not locking the lever element by the return movement of the breechblock by an interaction of the breechblock with the deflection lever.

14. A device in accordance with claim 13, wherein the recoil lever has an adjusting pin that can be brought into working connection with a return lever of the adjusting lever; and the adjusting lever is adjusted into an initial starting position via the return lever during the return movement of the recoil lever in an adjusting lever non-deflected starting position by the adjusting pin.

15. A device for the simulation of the recoil of a firearm which is retrofitted as a laser gun for training purposes, the device comprising:

a knockover slide;

a breechblock, said breechblock being movable between a closed starting position and an open end position with the knockover slide;

a hydraulic working piston in indirect or direct working connection with the breechblock;

a hydraulic chamber comprising hydraulic fluid;

a control mechanism for controlling the hydraulic working piston, the working piston being acted on by said hydraulic fluid such that said working piston is moved into a working position to move the breechblock from the starting position into the end position;

a pressure valve;

a discharge valve;

a return chamber;

a valve pressure lever that is deflected by an adjusting movement of the knockover slide and brings about an opening of the pressure valve, as a result of which said hydraulic fluid is fed under high system pressure to the working piston, the pressure valve being connected with the hydraulic chamber;

a gas pressure chamber filled with a compressed gas;

a movable separating piston associated with the hydraulic chamber, the movable separating piston defining one end of said gas pressure chamber and one end of said hydraulic chamber, whereby said movable separating piston separates and seals said hydraulic chamber from said gas pressure, said movable separating piston being acted on by the compressed gas, the working piston indirectly or directly, at the end of the adjusting movement bringing about a closing of the pressure valve and an opening of the discharge valve at the same time or in a time-delayed manner and the hydraulic fluid is conveyed, with the open discharge valve from the working piston into the return chamber.

16. A device in accordance with claim 15, further comprising:

a return channel, said hydraulic working piston being movably mounted in a cylinder, said return channel connecting an area adjacent to said cylinder to said return chamber;

an adjusting piston hermetically mounted for movement in said return chamber such that said adjusting piston is movable in an axial direction in said return chamber, wherein said adjusting piston is movable from a start position to an end position for increasing a volume of said return chamber to receive said hydraulic fluid of said hydraulic chamber via said return channel, wherein said hydraulic fluid is entirely conveyed back into said hydraulic chamber by resetting said adjusting piston in said return chamber from said end position to said starting position.

17. A device in accordance with claim 15, wherein:

the pressure valve has a tappet, via which a valve ball of the pressure valve can be brought from the closed position into the open position; and the tappet can be adjusted by a drag lever, an adjusting movement of the tappet being brought about by the valve pressure lever in an active, deflected working position.

18. A device in accordance with claim 17, wherein:

the active, deflected working position of the valve pressure lever is fixed by a breech catch provided with a locking element, meshing with the valve pressure lever; and the recoil lever has a deflecting nose, which can be brought into working connection with a stop web of the breech catch in such a way that the breech catch can be adjusted from a breech catch meshed position locking with the valve pressure lever, in an end range of the adjusting movement of the recoil lever, into a position not locking the valve pressure lever.

19. A device in accordance with claim 18, further comprising a spring-loaded adjusting lever held in an inactive starting position by the locking element of the breech catch, wherein:

the breech catch is brought by the deflecting nose, after release of the valve pressure lever at the end of the adjusting movement of the recoil lever, into a switching position, in which the adjusting lever is released; and after release of the adjusting lever, the adjusting lever performs an adjusting movement, by means of which another lever element is adjusted into an active pivoting position for opening the discharge valve.

20. A device in accordance with claim 19, wherein:

the active pivoting position of the lever element is fixed by a catch lever provided with a locking finger, which can be brought into locking connection in a spring-loaded manner with the lever element;

the catch lever has a deflection lever located in the locked position of the catch lever in the movement path of the breechblock; and the catch lever is brought into a neutral position not locking the lever element by the return movement of the breechblock by an interaction of the breechblock with the deflection lever.

* * * * *